US011242233B2

(12) United States Patent
Nedjimi et al.

(10) Patent No.: US 11,242,233 B2
(45) Date of Patent: Feb. 8, 2022

(54) METHOD FOR ALERTING A PERSON NEAR A VEHICLE WHEN SAID VEHICLE PERFORMS A MOVEMENT AND VEHICLE

(71) Applicant: Volvo Construction Equipment AB, Eskilstuna (SE)

(72) Inventors: Ahcène Nedjimi, Lyons (FR); Lilian Bruyere, Belley (FR)

(73) Assignee: Volvo Construction Equipment AB, Eskilstuna (SE)

( * ) Notice: Subject to any disclaimer, the term of this patent is extended or adjusted under 35 U.S.C. 154(b) by 82 days.

(21) Appl. No.: 16/772,184

(22) PCT Filed: Dec. 14, 2017

(86) PCT No.: PCT/IB2017/001743
§ 371 (c)(1),
(2) Date: Jun. 12, 2020

(87) PCT Pub. No.: WO2019/116068
PCT Pub. Date: Jun. 20, 2019

(65) Prior Publication Data
US 2021/0070596 A1 Mar. 11, 2021

(51) Int. Cl.
*B66F 17/00* (2006.01)
*B66F 9/075* (2006.01)
*G08B 3/10* (2006.01)

(52) U.S. Cl.
CPC ..... *B66F 17/00* (2013.01); *B66F 9/0755* (2013.01); *G08B 3/10* (2013.01)

(58) Field of Classification Search
CPC ..... B66F 17/00; B66F 9/0755; G08B 3/10
See application file for complete search history.

(56) References Cited

U.S. PATENT DOCUMENTS 5,684,461 A * 11/1997 Jones ..... G08B 21/06 340/439
6,549,139 B2 * 4/2003 Shaw, Jr. ..... B66C 13/44 212/276
7,852,229 B1 * 12/2010 Gohl ..... E02F 9/24 340/685
2015/0110285 A1 * 4/2015 Censo ..... G10K 11/178 381/71.4
2015/0210180 A1 * 7/2015 Hua ..... H01M 10/484 701/32.3
2016/0234601 A1 * 8/2016 Yuasa ..... H04R 1/028
2019/0093311 A1 * 3/2019 Naito ..... B60Q 9/008

FOREIGN PATENT DOCUMENTS

EP 2511677 A1 10/2012

OTHER PUBLICATIONS

International Search Report and Written Opinion of the International Searching Authority, PCT/IB2017/001743, dated Sep. 10, 2018, 8 pages.

* cited by examiner

*Primary Examiner* — Thomas D Alunkal
(74) *Attorney, Agent, or Firm* — Sage Patent Group

(57) ABSTRACT

A method is provided for alerting a person near a vehicle when said vehicle performs a movement. The vehicle is equipped with at least two speakers configured to emit sound alarms in opposite directions and each speaker that is oriented in the direction of the movement emits a first sound alarm, while each other speaker emits no sound or a second sound alarm that is different from the first sound alarm.

18 Claims, 4 Drawing Sheets

METHOD FOR ALERTING A PERSON NEAR A VEHICLE WHEN SAID VEHICLE PERFORMS A MOVEMENT AND VEHICLE

CROSS REFERENCE TO RELATED APPLICATIONS

This application is a 35 U.S.C. § 371 national stage application of PCT International Application No. PCT/IB2017/001743 filed on Dec. 14, 2017, the disclosure and content of which is incorporated by reference herein in its entirety.

TECHNICAL FIELD

The present invention concerns a method for alerting a person near a vehicle when said vehicle performs a movement. The invention also concerns a vehicle with which such method can be implemented.

BACKGROUND

In the field of construction, it is known to equip the vehicles with a speaker for emitting a sound alarm when the vehicle is moving. The speaker is usually a central speaker diffusing the sound alarm in all directions around the vehicle. With this kind of speaker, all of the persons near the vehicle are alerted when the vehicle performs a movement, even those which are not in a dangerous area. This is obviously uncomfortable.

One of the most dangerous movements of an excavator is the rotation of the upper frame (also called swing). When the excavator is working during a long period, workers are tempted to get closer than they should from the vehicle and thus enter in an area that is reachable by the vehicle, and in particular by a rotation of the excavator boom. There is then a risk of collision when a swing motion is triggered by the operator.

The aim of the present invention is to propose an improved method that remedies the abovementioned drawbacks.

SUMMARY

To this end, the invention concerns a method according to claim 1.

Thanks to the invention, the sound alarm that is emitted when the vehicle performs a movement is sent only or mainly in the direction of the movement of the vehicle. In the direction that is opposite to the movement of the vehicle the speaker(s) emit(s) no sound or a second sound alarm that is different from the first sound alarm. The persons that can be located in the trajectory of the vehicle in movement and who are thus exposed to a risk of collision with the vehicle are warned. The other persons who are not exposed to a risk of a collision with the vehicle hear no sound or almost no sound. The vehicle is then less noisy.

Further advantageous features of the method are specified in claims 2 to 12.

The invention also concerns a vehicle according to claim 13.

Further advantageous features of the vehicle are specified in claims 14 to 18.

BRIEF DESCRIPTION OF THE DRAWINGS

The invention will be better understood from reading the following description, given solely by way of four non-limiting examples and with reference to the appended drawings, which are schematic depictions, in which.

DETAILED DESCRIPTION OF EXAMPLE EMBODIMENTS OF THE INVENTION

Figure 1:
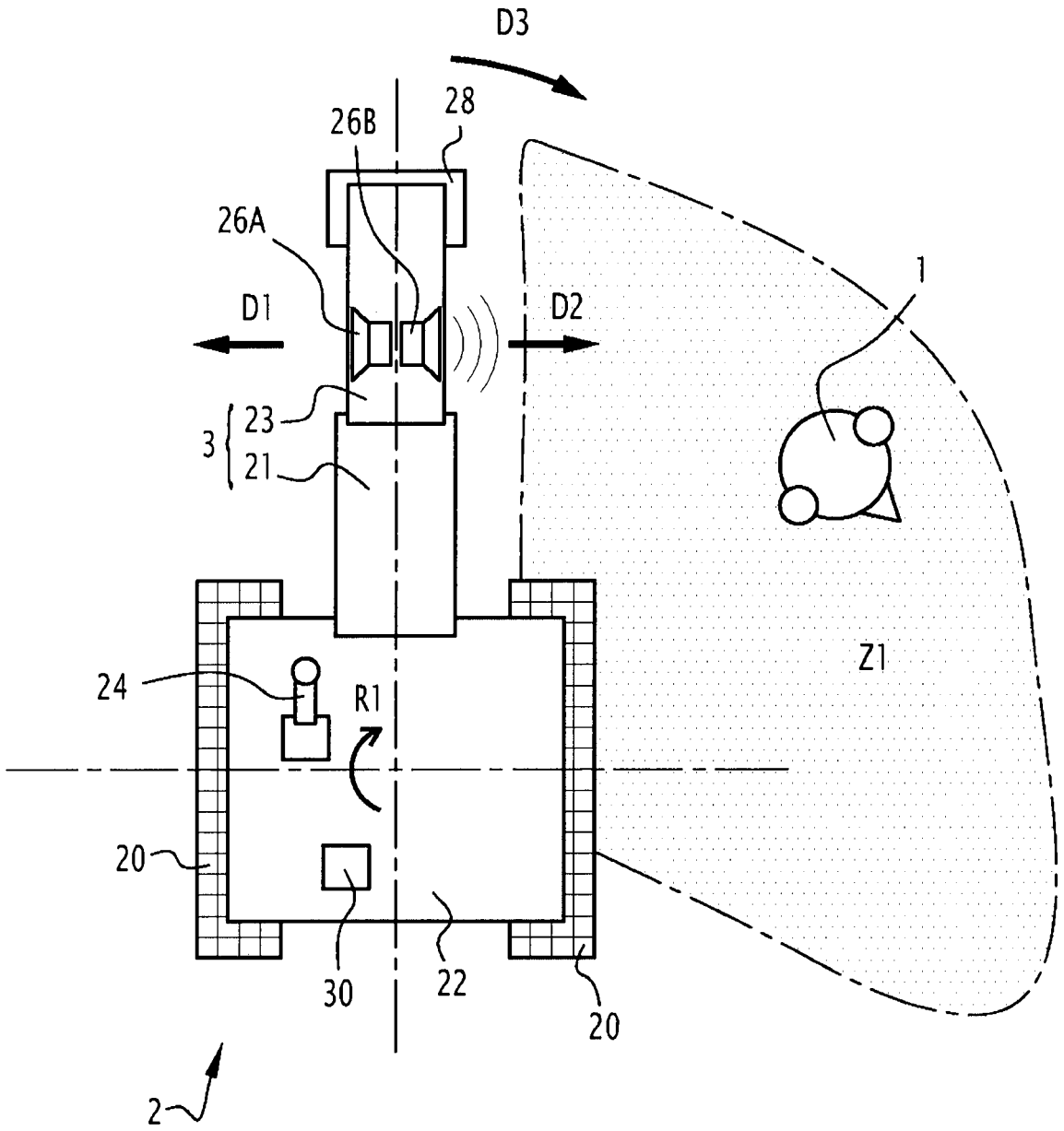
FIG. 1 is a scheme illustrating a first embodiment of a method for alerting a person near a vehicle when said vehicle performs a movement.

FIG. 1 shows, in top view, a vehicle 2, which is preferably a construction vehicle, in particular an excavator. The excavator 2 includes a lower frame (not visible on the figure) that is equipped with caterpillars 20 (or tracks 20) for moving over the ground surface and an upper frame 22 that is movable in rotation (about a vertical axis) relative to the lower frame. In practice, a cabin (not represented) inside which the driver may seat is arranged on the upper frame. The cabin includes controls for the movement(s) of the excavator. In particular, the controls include a joystick 24 for controlling the rotation of the upper frame relative to the lower frame, and a fortiori the rotation of an excavator boom 21.

The excavator boom 21 is secured to the upper frame 22 and is articulated with respect to the upper frame. A dipper 23 is attached to the end of an excavator boom 21, opposite to the frame 22. The dipper is articulated with respect to the excavator boom 21. The excavator boom 21 and dipper 23 form a mechanical arm 3 that is, in known manner, extendable. The dipper 23 includes, for instance, at its free end a bucket 28 for digging in the ground. The bucket 28 is articulated with respect to the dipper 23.

The excavator 2 includes two speakers 26A and 26B configured to emit sound alarms in opposite directions D1 and D2 when the excavator performs a movement.

Preferably, speakers 26A and 26B are cone loudspeakers, comprising each a cone. In the example, the direction D1 or D2 of the sound alarm emitted by speaker 26A or 26B coincides with a central axis of the cone of the speaker.

In the example, the movement performed by the vehicle is a rotation of the excavator boom 21 around a vertical axis that is controlled by pivoting joystick 24, as represented by arrow R1. However, in a non-represented alternative embodiment, the movement may be a rotation of the vehicle around itself. This is applicable to tracked vehicle that are capable of such movement. Indeed, when the tracks 20 are both moved in opposite directions, the vehicle rotates around itself and it may be advantageous to alert the person in danger with a sound alarm.

In the example, directions D1 and D2 are parallel to each other. However, in the meaning of the invention, two opposite directions are not necessarily parallel. For example, the angle between two opposite direction may be comprised between 120° and 240°.

Advantageously, the two speakers 26A and 26B are arranged on the mechanical arm 3 and are oriented to emit sound alarms on the sides of the mechanical arm 3. Accordingly, directions D1 and D2 are perpendicular to the excavator boom 21. From a perspective of the excavator driver, speaker 26B is oriented to emit a sound alarm on the right side, while speaker 26A is oriented to emit a sound alarm to the left side.

Preferably, the speakers 26A and 26B are arranged in the middle of the excavator dipper 23 (see FIG. 1). However, in a non-represented alternative embodiment, the speakers 26A and 26B may be arranged on the side of the excavator boom 21, i.e. close to the cabin. Also, the excavator dipper 23 or the excavator boom 21 may include more than two speakers.

The excavator 2 further includes an electronic control unit (ECU) 30 for controlling the speakers 26A and 26B. The ECU 30 is programmed to identify, when the excavator 2 performs a movement, in particular when the excavator boom 21 is rotated, which speaker (among speakers 26A and 26B) is oriented in the direction D3 of the movement. In the shown example, the movement direction D3 is a rotation to the right. Then, speaker 26B is the one that is oriented in the movement direction D3.

In the shown example, reference 1 denotes a person that is on the right of the vehicle from the perspective of the driver. The person 1 is considered to be in a dangerous zone Z1, accessible to the excavator boom 21 when the latter is rotated to the right. In other words, the zone Z1 is the travel area of the excavator boom 21. Accordingly, any person in this zone Z1 may be impacted by the excavator boom 21 during the rotation. The person 1 may be a worker or a bystander (pedestrians for instance).

The ECU 30 is further programmed so that the speaker 26B that is oriented in the movement direction D3 emits a first sound alarm, while the other speaker 26A emits no sound. Therefore, the sound alarm associated to the movement of the vehicle is sent only in direction of the person 1 in the dangerous zone Z1. The other person(s), for example the persons located to the left of the vehicle (from the perspective of the driver), hear no sound or almost no sound. The vehicle then appears to be less noisy.

Thus, when the driver requests a rotation of the mechanical arm 3 using the joystick 24, the ECU 30 determines the movement direction D3 and identifies which speaker is oriented in the movement direction D3. Only this speaker (26B in the example) emits a sound alarm.

In particular, in the meaning of the invention, a speaker is configured to emit a sound alarm in the direction of the movement when the angle between the orientation of the speaker, i.e. the sound alarm direction (D1 or D2 in the example), and the direction of the movement (D3 in the example) is less than 90°, preferably less than 30°.

In a non-represented alternative embodiment, when the driver requests a rotation of the excavator around itself, i.e. a movement of both tracks 20 in opposite directions, the ECU 30 determines the direction of rotation (the movement direction) and identifies which speaker is oriented in the movement direction. Only this speaker emits a sound alarm.

Figure 2:
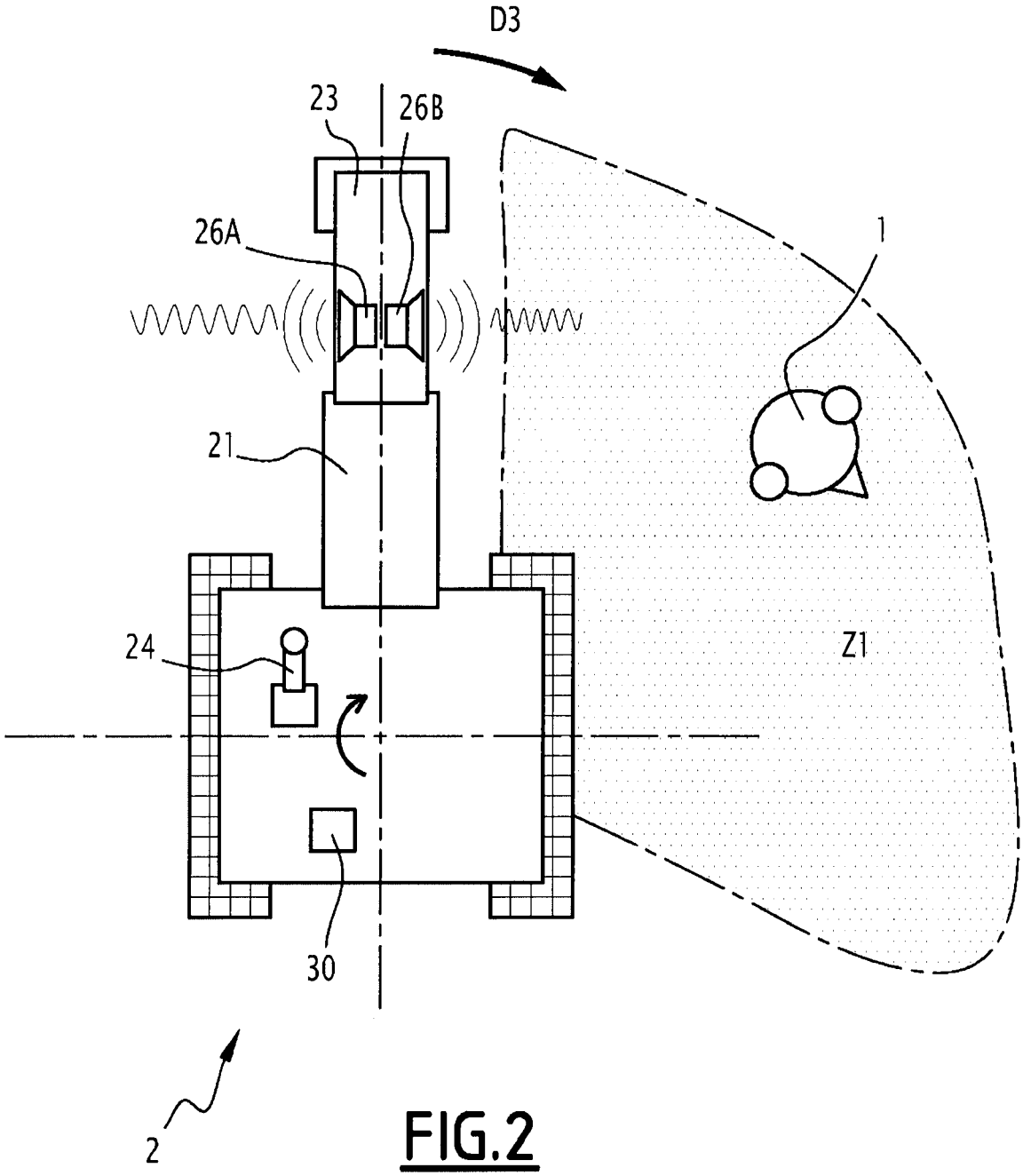
FIG. 2 is a scheme analog to FIG. 1, illustrating a second embodiment of the method.

A second embodiment is described here-after in connection with FIG. 2, which is also a top view. For conciseness purpose, only the distinctive features relative to the first embodiment are mentioned.

In the embodiment of FIG. 2, the speaker 26B that is oriented in the movement direction D3 emits a first sound alarm, while the other speaker 26A emits a second sound alarm that is different from the first sound alarm.

Advantageously, the first sound alarm has a first pitch, that is to say a first frequency, and the second sound alarm has a second pitch that is lower than the first pitch. More preferably, the first sound alarm is high-pitched, i.e. having a high frequency, while the second sound alarm is low-pitched, i.e. having a low frequency. This gives the person 1 in the zone 1 the feeling that the excavator boom 21 is approaching. To the contrary, this gives the person outside zone Z1 the feeling that the excavator boom 21 is moving away. The safety of the workers around the vehicle is then increased. Both feelings are natural feelings arising from Doppler effect. As a reminder, the Doppler effect is the apparent difference between the frequency of an audio signal generated by a source that is approaching from an observer and an audio signal generated by a source that is moving away from the observer. Naturally, an observer perceives an audio signal of an approaching source with a higher pitch than an audio signal of a source that is moving away, which is more low-pitched. The aim is then to reproduce this natural feeling by adjusting the frequency of the speakers sound alarms depending on the movement direction of the vehicle, and in particular on the movement direction of the excavator boom 21.

In an alternative of the second embodiment, instead of or in addition of adjusting the pitch, it is possible to adjust the sound intensity. For instance, the first sound alarm may be emitted with a sound intensity that is higher than the second sound alarm.

Figure 4:
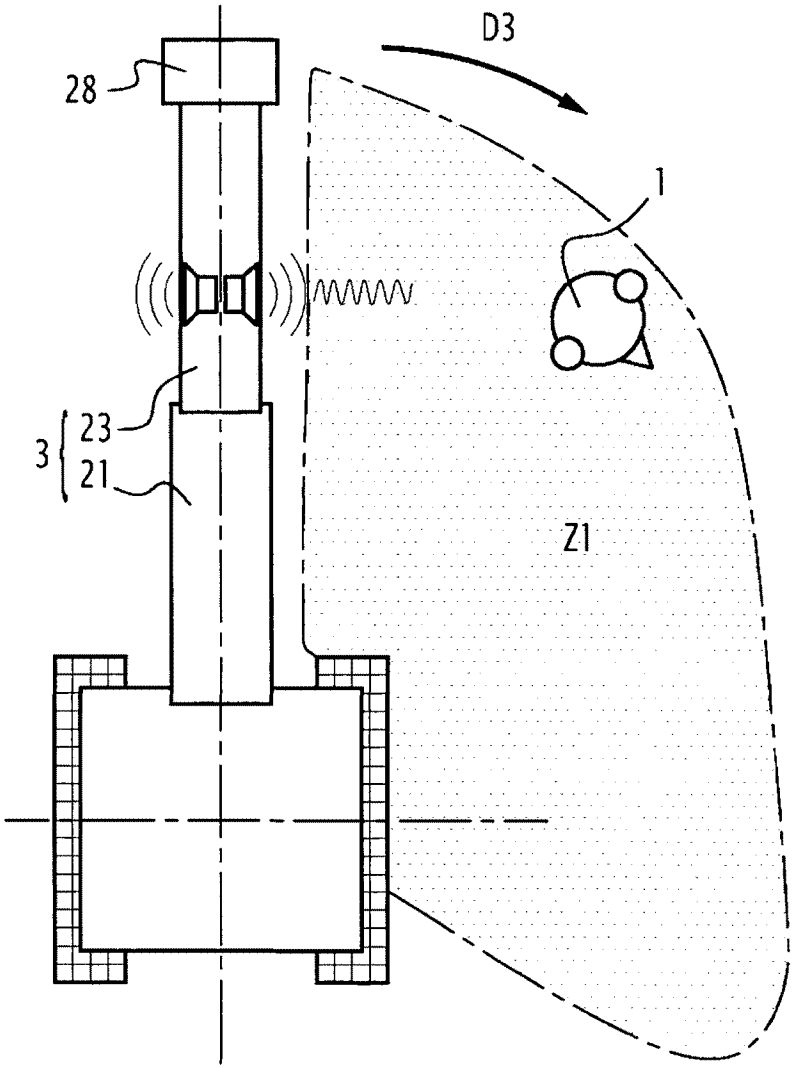
FIGS. 3 and 4 are schemes illustrating a third embodiment of the method.
Figure 3:
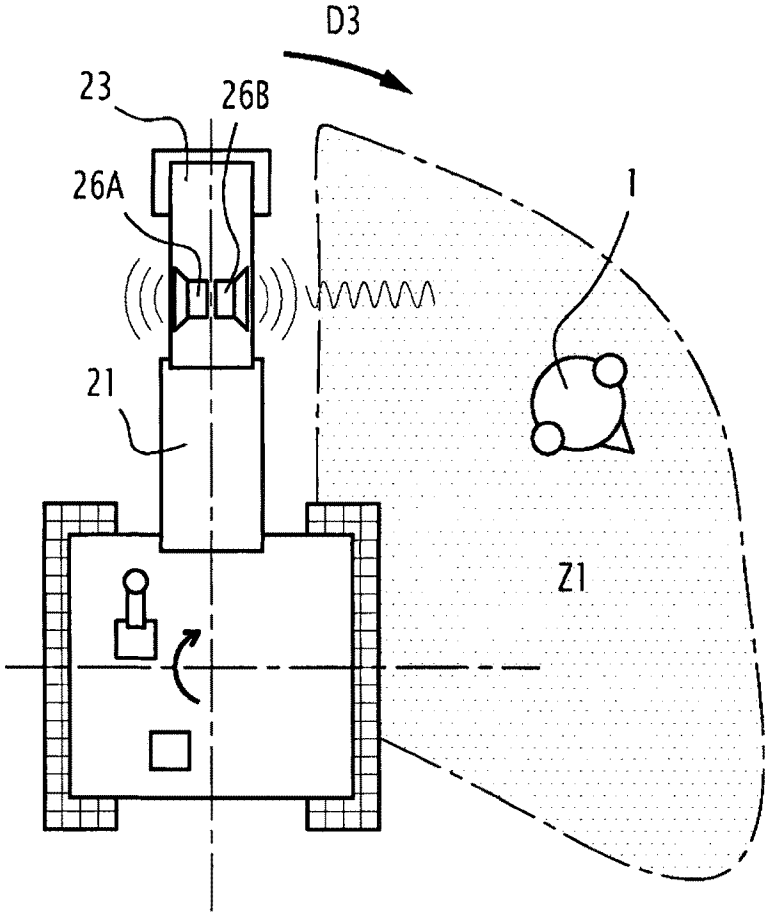

A third embodiment is described here-after in connection with FIGS. 3 and 4. For conciseness purpose, only the distinctive features relative to the preceding embodiments are mentioned.

In the embodiment of FIGS. 3 and 4, which are also top views, the frequency of the first sound alarm is higher when the mechanical arm 3, i.e. the excavator boom 21 and the dipper 23, is extended at maximum. This means that the frequency of the first sound alarm depends on the degree of extension of the arm 3. In particular, the more the arm 3 is extended, the more the first sound alarm is high-pitched, i.e. the more the sound alarm frequency is high.

Therefore, Doppler effect is emphasized when the mechanical arm 3 is extended to take into account that, at the same rotational speed, the tangential speed at the free end of the arm 3 (i.e. at the bucket 28) is higher when the arm 3 is extended than when the arm 3 is retracted. Accordingly, the danger is more important when the arm 3 is extended and it is advantageous that the person(s) located in the travel zone of the excavator boom 21 and the dipper 23 feel a more dangerous situation.

In a non-represented alternative embodiment, the intensity of the sound alarm of the speaker that is oriented in the direction of rotation of the mechanical arm 3 depends on the degree of extension of the arm 3. In particular, the more the arm 3 is extended, the louder is the sound alarm.

Intensity and/or frequency of the sound alarm of the speaker that is oriented in the direction of rotation of the mechanical arm 3 may depend on the rotation speed of the upper frame 22 with respect to the lower frame. In particular, the more the rotation speed, the louder is the sound alarm and/or higher is the frequency of the sound alarm.

Figure 5:
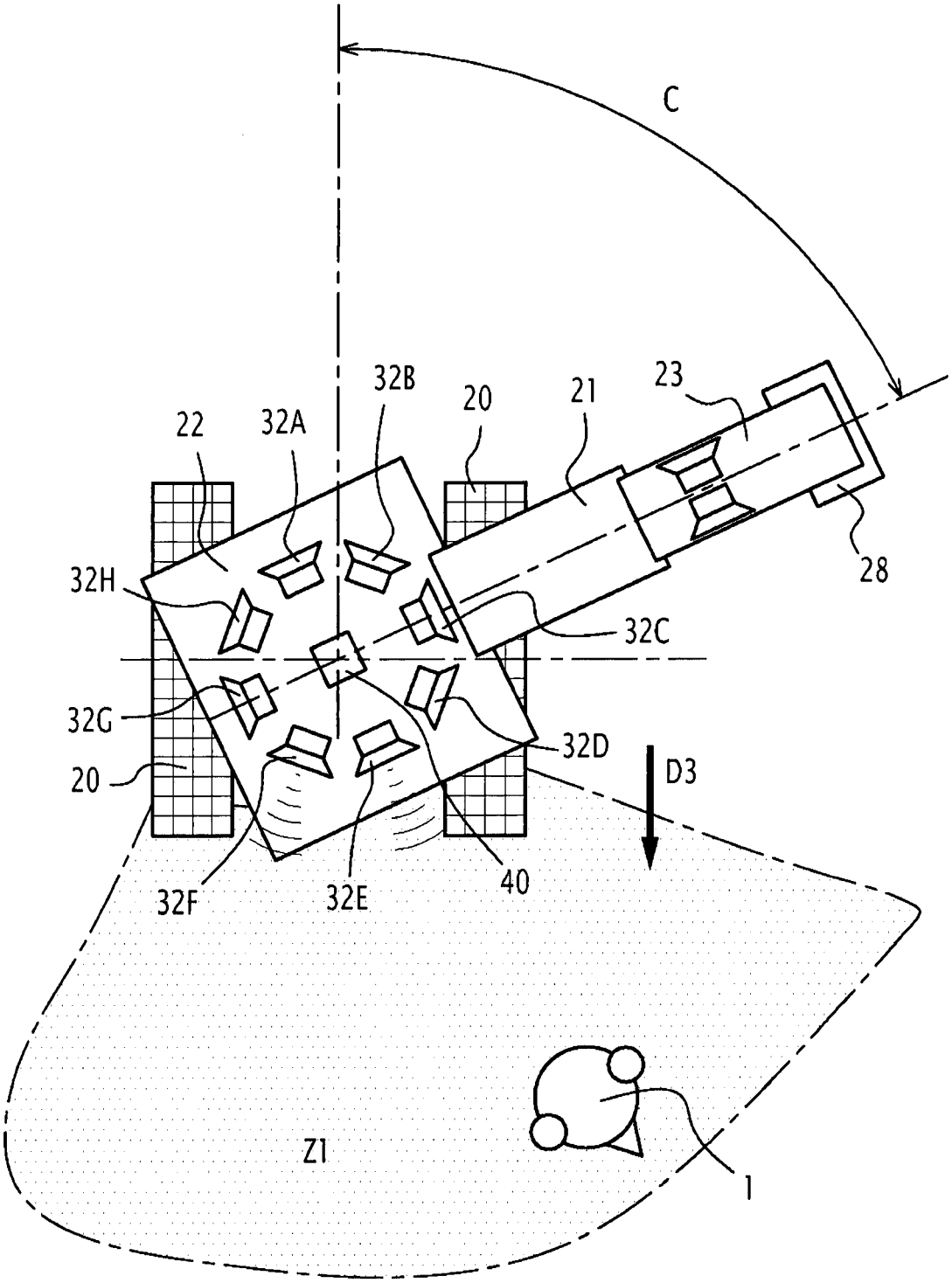
FIG. 5 is a scheme illustrating a fourth embodiment of the method.

A fourth embodiment is described here-after in connection with FIG. 5, which is also a top view. For conciseness purpose, only the distinctive features relative to the preceding embodiments are mentioned.

In the embodiment of FIG. 5, the upper frame 22 includes at least four double opposed speakers, in particular eight double opposed speakers 32A to 32H. This means that there are four pairs of speakers and that the speakers of each pair are oriented to emits sound alarms in opposite directions. Thanks to this configuration, it is possible to emit a sound alarm in the direction of a turn (left and right).

For example, the speakers may be arranged on the roof of the cabin.

Speakers 32A to 32H are configured to alert the person(s) near the vehicle of a displacement of the vehicle over the ground surface.

In a known manner, the excavator includes two control levers (not represented) for moving the tracks 20 (caterpillars), i.e. one control lever for each track 20.

Preferably, the excavator comprises an angular sensor 40 for measuring the orientation of the upper frame 22 relative to the lower frame of the excavator, i.e. the orientation of the cabin relative to the direction of the tracks 20, which is represented on FIG. 5 with angle C.

When the driver requests a tracks motion using the control lever(s), the ECU determines the movement direction D3 based on the driver request. In the example, the driver requests the movement of both tracks 20 in the same direction, i.e. the displacement of the vehicle in a straight direction. The angular sensor 40 provides the ECU with the orientation C of the upper frame 22 relative to the lower frame. Then, the ECU is able to determine at least one of the speakers 32A to 32H that is oriented in the movement direction D3. In the example, speakers 32E and 32F are both oriented in the movement direction D3. Therefore, speakers 32E and 32F emit both a sound alarm when the vehicle performs the movement, while the other speakers (i.e. all of the other speakers) emit no sound.

It is to be reminded that, in the meaning of the invention, a speaker is configured to emit a sound alarm in the direction of the movement when the angle between the orientation of the speaker, i.e. the sound alarm direction, and the direction of the movement (D3 in the example) is less than 90°, preferably less than 30°. Accordingly, several speakers may be configured as oriented in the direction of the movement and each one of said several speakers emits a sound alarm.

In a non-represented alternative embodiment, the vehicle is different from an excavator. It may be any other construction vehicle, such as a transport truck, a crane, a truck crane, etc.

In another non-represented alternative embodiment, the caterpillars may be replaced by wheels.

In each embodiment, the frequency and/or the intensity of the sound alarm emitted by each speaker oriented in the movement direction of the vehicle may be modified depending on the speed of the motion. In particular, the more the movement speed is high, the more the frequency and/or the intensity of the sound alarm is or are important. This enables adapting the characteristics of the sound alarm in function of the nervousness of the driver. Indeed, a driver that is nervous will tend to make sudden movements, which are more dangerous for the person around the vehicle. Therefore, the idea is to take into account this parameter, by measuring the motion speed, when warning the person(s) in a dangerous area with a sound alarm. When the frequency and/or the intensity of the sound alarm is increased, the perception of danger is emphasized, in particular thanks to Doppler effect.

The features of the described embodiments and non-represented alternative embodiments may be combined in order to generate new embodiments of the invention. For instance, the fourth embodiment may be combined with the second embodiment. In this case, the speaker that is oriented in the movement direction of the vehicle emits a first sound alarm that is high-pitched, while the opposed speaker emits a second sound alarm that is different from the first sound alarm, in particular that is low-pitched. In the example, and for the purpose of understanding, the speakers 32E and 32F emit each a first sound alarm and the speakers 32A and 32B emit each a second sound alarm that is different from the first sound alarm. However, the other speakers, i.e. the speakers 32G, 32H, 32C and 32D emit no sound. Then, in this embodiment, at least one of the speakers emits a first sound alarm, at least one of the speakers emits a second sound alarm that is different from the first sound alarm and at least one of the speakers emits no sound.

Preferably, the first sound alarm has a first pitch, that is to say a first frequency, and the second sound alarm has a second pitch that is lower than the first pitch. More preferably, the first sound alarm is high-pitched, i.e. having a high frequency, while the second sound alarm is low-pitched, i.e. having a low frequency.

Also, still in the fourth embodiment, the frequency and/or the intensity of the sound alarm emitted by each speaker oriented in the movement direction of the vehicle may be modified depending on the speed of the motion and/or on the degree of extension of the mechanical arm 3 if the vehicle includes such equipment.

The invention claimed is:

1. A method for alerting a person near a vehicle when said vehicle performs a movement, wherein the vehicle is equipped with at least two speakers configured to emit sound alarms in opposite directions, the method comprising:

each speaker that is oriented in a direction of the movement emits a first sound alarm, while each other speaker emits no sound or a second sound alarm that is different from the first sound alarm.

2. A method according to claim 1, wherein the first sound alarm has a first pitch and the second sound alarm has a second pitch lower than the first pitch.

3. A method according to claim 1, wherein the first sound alarm has a given sound intensity and the second sound alarm has a sound intensity lower than the sound intensity of the first sound alarm.

4. A method according to claim 1, wherein the vehicle includes a mechanical arm.

5. A method according to claim 1 wherein:

the vehicle is an excavator including a lower frame and an upper frame that is movable in rotation relative to the lower frame and that includes a mechanical arm comprising an excavator boom and a dipper, the excavator boom is articulated with respect to the upper frame and the dipper is articulated with respect to excavator boom, and the two speakers are arranged on the mechanical arm.

6. A method according to claim 4, wherein the mechanical arm is movable between a retracted position and an extended position and in that the frequency of the first sound alarm is higher when the mechanical arm is in the extended position than when it is in the retracted position.

7. A method according to claim 4, wherein the first sound alarm is louder when the mechanical arm is in the extended position than when it is in the retracted position.

8. A method according to claim 1, wherein the movement is a rotation of a mechanical arm of the vehicle or a displacement of the vehicle over the ground surface, including right and left turns.

9. A method according to claim 1, wherein the intensity of the first sound alarm depends on the speed of the movement.

10. A method according to claim 1, wherein the frequency of the first sound alarm depends on the speed of the movement.

11. A method according to claim 1, wherein the vehicle includes:

a lower frame and an upper frame movable in rotation relative to the lower frame, the upper frame including at least four double opposed speakers, an angular sensor for measuring the orientation of the upper frame relative to the lower frame, and characterized in that the method includes steps consisting in:

measuring the orientation of the upper frame with respect to the lower frame, and in identifying, when said vehicle performs a movement, which speaker(s) is or are oriented in the direction of the movement, in function of the orientation of the upper frame with respect to the lower frame.

12. A method according to claim 1, wherein a speaker is identified as oriented in the direction of the movement when the angle between the sound alarm direction of the speaker and the direction of the movement is less than 90°, preferably less than 30°.

13. A vehicle comprising:

at least two speakers configured to emit sound alarms in opposite directions; and an electronic control unit for controlling the speakers and in that the electronic control unit is programmed to identify, when said vehicle performs a movement, which speaker or which speakers are oriented in the direction of the movement and to control the speakers so that each speaker that is oriented in the movement direction emits a first sound alarm, while each other speaker emits no sound or a second sound alarm that is different from the first sound alarm.

14. A vehicle according to claim 13, wherein the vehicle includes a lower frame and an upper frame movable in rotation relative to the lower frame, the upper frame including at least four double opposed speakers.

15. A vehicle according to claim 14, wherein the vehicle includes an angular sensor for measuring the orientation of the upper frame relative to the lower frame.

16. A vehicle according to claim 13, wherein the vehicle is a construction vehicle.

17. A vehicle according to claim 13, wherein:

the vehicle is an excavator including a lower frame and an upper frame that is movable in rotation relative to the lower frame and that includes a mechanical arm comprising an excavator boom and a dipper, the excavator boom is articulated with respect to the upper frame and the dipper is articulated with respect to excavator boom, and the two speakers are arranged on the mechanical arm.

18. A vehicle according to claim 13, wherein the vehicle includes caterpillars.

* * * * *